US006817900B2

(12) United States Patent
Yamawaki et al.

(10) Patent No.: US 6,817,900 B2
(45) Date of Patent: Nov. 16, 2004

(54) ELECTRICAL CONNECTOR HAVING TERMINAL LOCKING STRUCTURE

(75) Inventors: Takanori Yamawaki, Shizuoka (JP); Hisashi Machii, Shizuoka (JP); Kuninori Matsubara, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 3 days.

(21) Appl. No.: 10/207,075

(22) Filed: Jul. 30, 2002

(65) Prior Publication Data

US 2003/0027455 A1 Feb. 6, 2003

(30) Foreign Application Priority Data

Jul. 31, 2001 (JP) ..... 2001-232004
Jul. 31, 2001 (JP) ..... 2001-232008

(51) Int. Cl.[7] ..... H01R 13/40
(52) U.S. Cl. ..... 439/595; 439/744; 439/871
(58) Field of Search ..... 439/589, 274, 439/595, 271, 272, 273, 275, 597, 752, 701, 744, 871

(56) References Cited

U.S. PATENT DOCUMENTS 4,944,688 A * 7/1990 Lundergan ..... 439/275
4,973,268 A * 11/1990 Smith et al. ..... 439/595
5,575,684 A 11/1996 Uchida et al.
5,613,868 A * 3/1997 Ohsumi et al. ..... 439/275
5,707,251 A * 1/1998 Sakai et al. ..... 439/589
5,738,551 A * 4/1998 Matsuoka ..... 439/752
6,062,906 A * 5/2000 Tanaka ..... 439/595
6,126,484 A 10/2000 Klein et al.
6,174,201 B1 * 1/2001 Murakami et al. ..... 439/587

FOREIGN PATENT DOCUMENTS

EP 1 209 766 A 5/2002
JP 2-110186 9/1990
JP 11-224713 8/1999

* cited by examiner

*Primary Examiner*—Gary Paumen
*Assistant Examiner*—Edwin A. Leon
(74) *Attorney, Agent, or Firm*—Armstrong, Kratz, Quintos, Hanson & Brooks, LLP

(57) ABSTRACT

A connector 1 has a resilient terminal locking arm 12 having a forward half 31 and a rear half 33, the forward half 31 partially defining a wall partition wall 11 for a terminal accommodating space 7 of a housing 2 of the connector, the rear half having a fore end to serve as a terminal stopping surface 32. The terminal stopping surface 32 is positioned at a middle of the terminal locking arm 12 in a longitudinal direction of the connector. A pair of the forward arm halves 31 are provided to be opposed to each other in a transverse direction of the connector, and the terminal stopping surface 32 extends across a width of the terminal accommodation space 7 between the pair of forward halves. Furthermore, a holder combined connector has a connector housing 102, and a front holder 105, the connector housing 102 has a resilient terminal locking arm 113 in a terminal accommodating space, and the front holder 105 is coupled to a connector main part 104 of the connector housing to define the terminal accommodating chamber. The front holder 105 has a wall to define at least one of upper and lower walls 132, 110 of the terminal accommodating chamber when the front holder is completely coupled to the connector main part. The wall 112 of the front holder advances into a deflectable space of the terminal locking arm 113 to prevent a deflection of the terminal locking arm.

5 Claims, 9 Drawing Sheets

ELECTRICAL CONNECTOR HAVING TERMINAL LOCKING STRUCTURE

BACKGROUND OF THE INVENTION

1. Field of the Invention

The present invention relates to an electrical connector having a terminal locking arm which is supported at each end thereof in a housing of the connector.

Furthermore, the present invention relates to an electrical connector combined with a front holder, in which the front holder is coupled to a connector housing to define a terminal accommodating chamber.

2. Related Art

FIG. 5 shows an example of a terminal locking structure of a conventional connector which is disclosed in Japanese Utility Model Application Laid-open H. 2-110186.

The connector has a plug-type connector housing 51 made of a synthetic resin material, of which a terminal accommodating chamber 52 is formed with a resilient terminal locking arm 53. The terminal locking arm 53 is joined to the connector housing 51 at each longitudinal end of the terminal locking arm 53 for supporting the terminal locking arm 53. The terminal accommodating chamber 52 and the terminal locking arm 53 are provided both in upper and lower portions of the connector housing 51.

The terminal locking arm 53 has a locking protrusion 54 formed in a forward half thereof. The terminal accommodating chamber 52 has a rear opening for inserting a receptacle terminal 55 connected to an electrical cable. The terminal is locked by the terminal locking arm 53 and abuts against a stopping wall 56 positioned in the terminal accommodating chamber 52. The receptacle terminal 55 has a box-shaped electrical contact portion 57 in a fore half thereof and a cable crimping portion 58 in a rear half thereof. The electrical contact portion 57 has a bottom wall formed with an engagement hole 59 associated with a locking protrusion 54 of the terminal locking arm 53.

The receptacle terminal 55 moves into the terminal accommodating chamber 52 while the receptacle terminal 55 deflects the terminal locking arm 53 downward. The complete insertion of the receptacle terminal 55 moves upward the terminal locking arm 53 to resiliently return the arm to its original position and causes the locking protrusion 54 to engage with the engagement hole 59 of the receptacle terminal 55 to lock the receptacle terminal 55 in the terminal accommodating chamber 52. The receptacle terminal 55 and the connector housing 51 constitute a connector 60. In this specification, the connector 60 is inserted into a connector engagement space of an associated female connector.

The terminal locking structure of the conventional connector has the locking protrusion 54 formed in the forward half of the terminal locking arm 53 of the connector housing 51 for engagement with the electrical contact portion 57 formed in the forward half of the receptacle terminal 55. As illustrated in FIG. 5, the insertion of the receptacle terminal 55 deflects the terminal locking arm 53 such that the locking protrusion 54 moves not just downward but slightly diagonally forward as shown by an arrow A. Thus, the locking protrusion 54 does not completely engage with the engagement hole 59 so that the locking of the receptacle terminal 55 is insufficient when the locking protrusion 54 has an elongated length sufficiently longer than the engagement hole 59 of the receptacle terminal 55. However, the elongated engagement hole 59 causes an undesired looseness in locking of the receptacle terminal 55, so that a resilient contact piece provided in the electrical contact portion 57 of the receptacle terminal 55 suffers a friction wear due to vibration during an operating state of a motor vehicle in which the connector is provided.

Furthermore, since the terminal locking arm 53 deflects with an unstable bent, an arm deflecting space 61 should have a larger size, which disadvantageously requires a larger height of the connector housing 51 for deflection of the arm.

In view of the disadvantage of the conventional art, a first object of the invention is to provide an electrical connector having a terminal locking structure which eliminates a locking looseness of a terminal in the longitudinal direction of the terminal. This allows a reliable locking of the terminal and decreases a housing of the connector in size.

FIGS. 15 to 17 show an example of a conventional connector combined with a holder, which is disclosed in Japanese Patent Application Laid-open No. H. 11-224 713. The holder combined connector 181 (FIG. 16) is constituted by a connector housing 182 made of a synthetic resin material, a front holder 183 made of a synthetic resin material, and a terminal 185 having an electrical cable. The front holder 183 is inserted through a fore opening of the connector housing 182 to define a terminal accommodating chamber 184. The terminal 185 is inserted into the terminal accommodating chamber 184 from a rear opening of the connector housing 182.

As illustrated in FIG. 15, the connector housing 182 includes a resilient terminal locking arm 186 extended therein, and a terminal insertion hole 187 is formed in a rear side of the terminal locking arm 186 to partially define a terminal accommodating chamber.

The front holder 183 has a front wall 188, left and right side walls 189, a top wall 190, a short lower wall 191, and an intermediate partition wall 192. The front wall 188 is formed with an opposing connector inserting opening and an aperture for receiving a pushing rod for releasing the terminal from the locking of the arm.

As illustrated in FIG. 16, the front holder 183 has been completely received in the connector housing 182 to define the terminal accommodating chamber 184 surrounded by the intermediate wall 192 and the upper and lower walls 190, 191. In this state, the terminal 185 is inserted into the connector housing 182 and the terminal locking arm 186 abuts against a rear shoulder of a box-shaped electrical contact portion of the terminal 185 to lock the terminal.

As illustrated in FIG. 17 which is a sectional view taken along line C—C of FIG. 16, the terminal locking arm 186 is molded together with the connector housing 182 from a resin material in an absence state of the front holder 183. Thus, the terminal locking arm 186 can have a width extending close to the inner walls of the front holder 183, improving the locking force of the terminal locking arm 186 and decreasing the holder combined connector 181 in its lateral dimension.

The conventional holder combined connector 181 can decease a lateral dimension of the connector but is disadvantageous for decreasing a height of the connector housing 182. Because, the upper and lower walls 190, 191 of the front holder 183 overlap with upper and lower walls 193, 194 (FIG. 15) of the connector housing 182. Furthermore, the terminal 185 should be double locked by the terminal locking arm 186, which requires another member to increase the locking force, and the additional locking member tends to complicate the locking structure and mechanism of the terminal and to increase the size of the holder combined connector 181.

In view of the aforementioned disadvantage of the conventional connector, a second object of the invention is to provide a holder combined connector which is decreased particularly in the height thereof (in a vertical direction of FIG. 16) with keeping a reliable electrical connection with an opposing connector. Furthermore, the connector can lock double a terminal surely with ease.

SUMMARY OF THE INVENTION

For achieving the first object, an electrical connector has a terminal locking structure according to a first aspect of the present invention. The terminal locking structure includes a resilient terminal locking arm having a forward half and a rear half, the forward half defined by a wall for a terminal accommodating space of a housing of the connector, the rear being larger than the forward half in width, the rear half having a fore end to serve as a terminal stopping surface. Preferably, the rear half has a surface tapered in a longitudinal direction of the connector.

In the above-mentioned structure, the terminal moves into the terminal accommodation space while the terminal deflects the rear half of the terminal locking arm. At the same time, the forward half of the terminal locking arm unitarily formed with the rear half also deflects smoothly perpendicular to the terminal insertion direction. On complete insertion of the terminal, the terminal locking arm surely returns to its original position and the fore end stopping surface of the rear half abuts against a rear shoulder of the terminal to reliably lock the terminal.

Furthermore, the forward half of the terminal locking arm serves as a partition of the connector housing so that a longer locking arm can be provided without a larger space for receiving the locking arm. This decreases the connector housing in size. The terminal locking arm deflects with ease, allowing a smaller insertion force of the terminal. Moreover, since the fore end of the rear half of the terminal locking arm serves as a terminal stopping surface, a locking projection which is required for the conventional connector is eliminated. The connector housing is deceased in size by the height of the locking projection. The fore end of the rear half of the terminal locking arm directly locks the terminal, improving the reliability of the locking.

Preferably, the terminal stopping surface is positioned substantially at a middle of the terminal locking arm in the longitudinal direction of the connector.

The structure enables that the terminal stopping surface is positioned at the largest deflection point of the terminal locking arm when the terminal is inserted into the connector, and the terminal stopping surface moves just perpendicular to the longitudinal direction of the arm without a longitudinal deviation thereof. Thereby, the terminal stopping surface is correctly positioned in a stopped state of the terminal so that an undesired looseness therebetween can be eliminated. This prevents an increased longitudinal length of the connector housing which will be otherwise required. Furthermore, the terminal locking arm deflects not unstably but linearly unlike the conventional art so that a deflection space for the terminal locking arm is minimized, allowing a decreased dimension of the connector housing in the deflection direction of the terminal locking arm.

Preferably, the structure has a pair of the forward halves opposed to each other in a transverse direction of the connector, wherein the terminal stopping surface extends across a width of the terminal accommodation space between the pair of forward halves.

The structure allows the terminal stopping surface to have a sufficient width between the pair of the forward halves of the terminal locking arm to surely stop the stopped portion of the terminal. The terminal stopping surface is stably supported by the pair of the forward halves of the terminal locking arm so that the terminal stopping surface is correctly positioned on the stopped portion of the terminal, improving the reliability of the locking.

Preferably, the terminal locking arm has a lock releasing portion at a middle of the terminal locking arm in a longitudinal direction of the terminal locking arm so that a tip end of a pushing rod can push the lock releasing portion to release the terminal from the terminal locking arm.

The structure allows that the tip end of the pushing rod can push the lock releasing portion to release the terminal from the terminal locking arm at the middle of the terminal locking arm in the longitudinal direction of the terminal locking arm. Thus, the lock releasing portion is located at the maximum deflection position of the terminal locking arm so that the lock releasing portion moves just perpendicular to the longitudinal direction of the terminal locking arm without a deviation in the longitudinal direction. This allows a smaller space for the lock releasing portion, decreasing a dimension of the connector housing in the deflection direction of the terminal locking arm.

Preferably, the lock releasing portion is a projection formed on a side surface of the terminal locking arm.

The structure allows that the projection for releasing the locking is positioned adjacent to a partition of the terminal accommodation spaces. Thus, the pushing rod can be inserted along the partition to surely move the projection in the lock releasing direction, improving the lock releasing in workability and reliability.

For achieving the second object, a second aspect of the present invention is a holder combined connector having a connector housing and a front holder, the connector housing having a resilient terminal locking arm in a terminal accommodating space, the front holder coupled to a connector main part of the connector housing to define a terminal accommodating chamber, wherein the front holder has a wall to define at least one of upper and lower walls of the terminal accommodating chamber when the front holder is completely coupled to the connector main part.

In the aforementioned structure, the front holder is coupled to the housing main part so that the walls of the front holder define the upper and lower wall of the terminal accommodating space to complete a terminal accommodating chamber. This eliminates a bottom or top wall of the terminal accommodating chamber of the housing main part, decreasing the vertical dimension of the connector housing by an amount corresponding to the thickness of the bottom or top wall otherwise required for the terminal accommodating chamber.

Preferably, the wall of the front holder advances into a deflectable space of the terminal locking arm to prevent a deflection of the terminal locking arm.

In this structure, the wall of the front holder partially closes the terminal accommodating space and also prevents the deflection of the terminal locking arm to surely stop the terminal. This eliminates an additional stopping member for preventing the deflection of the arm, so that the connector structure is simplified and decreased in size.

Preferably, the front holder has a space to receive a top or bottom wall of the housing main part, and the wall of the front holder is positioned along the top or bottom wall of the housing main part.

In the structure, the front holder has a space to receive the top or bottom wall of the housing main part, so that the wall of the front holder overlaps with the top or bottom wall of the housing main part. Thus, the front holder is surely retained by the housing main part without looseness to be correctly positioned. This improves the connector in correct positioning of the terminal and in a reliable electrical connection with an opposing connector. Furthermore, the wall of the front holder, which contacts the top or bottom wall of the housing main part, prevents the distortion and warping of the top or bottom wall, surely limiting the deflection of the terminal locking arm. The top or bottom wall of the housing main part can be decreased in thickness, enabling a smaller height of the front holder or the connector.

Preferably, the wall of the front holder is positioned forward from the terminal deflection space and the terminal can be inserted into the terminal accommodating space when the front holder has been preliminarily engaged with the housing main part.

In the structure, the terminal which is inserted into the terminal accommodating space at a preliminarily engaged state of the front holder, is smoothly surely received along the wall of the front holder, and subsequently, the front holder is pushed into the housing main part opposite to the terminal insertion direction to be finally engaged with the housing main part. Thereby, the front holder wall has advanced into the deflectable space of the terminal locking arm to allow double locking of the terminal. The terminal is surely locked without an unintentional disengagement of the terminal.

Preferably, the housing main part is formed with a circumferential wall in a rear side of the housing main part for mounting a waterproof packing, and the terminal accommodating space is positioned forward from the circumferential wall, wherein the front holder is coupled to a fore side of the circumferential wall.

This configuration having the packing achieves a waterproof state between the connector and an opposing connector. The engagement of the circumferential wall with the front holder allows the front holder to be surely positioned and retained without looseness, improving an electrical connection with the opposing connector in reliability.

Preferably, the terminal accommodating space is defined between a pair of partition walls, and each of the partition walls is joined to a horizontal continuous wall to define the terminal accommodating space.

In this configuration, the partition walls of the terminal accommodating space, which are joined to the horizontal continuous wall, improves the housing main part in rigidity, preventing the warping and distortion thereof. Moreover, a plurality of the terminal accommodating spaces can be provided parallel to each other with a constant pitch. This improves the terminal received in each terminal accommodating space in its reliable electrical connection with an opposing terminal.

DETAILED DESCRIPTION OF THE PREFERRED EMBODIMENTS

Figure 1:
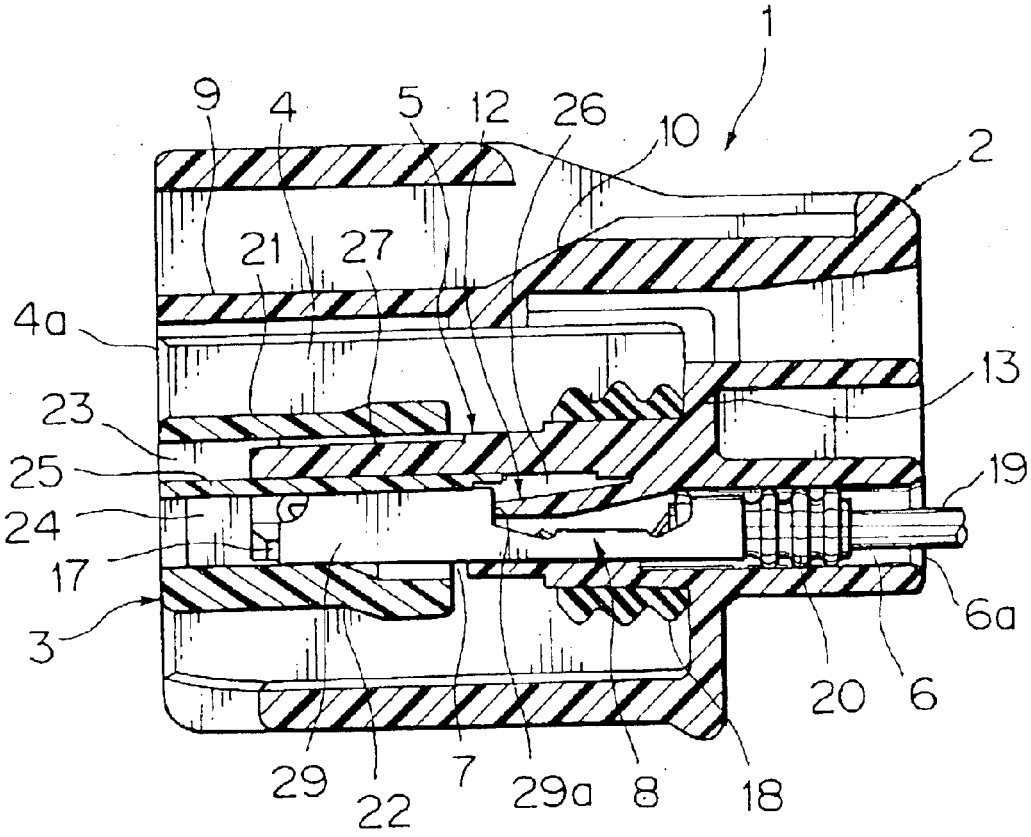
FIG. 1 is a longitudinal sectional view showing an embodiment of a connector having a terminal locking structure according to the present invention.

Referring to the accompanied drawings, embodiments of the present invention will be discussed in detail hereinafter. FIG. 1 shows a plug-type connector employing a terminal locking structure according to the present invention.

The connector 1 has a connector housing 2 made of a synthetic resin material, a front holder 3 also made of a synthetic resin material, and a receptacle terminal 8 with an electrical cable. The front holder 3 is inserted from a front opening 4*a* of the connector housing 2 into a housing main part 5 of a receiving space 4, and the terminal 8 is inserted from a rear opening 6*a* of a terminal insertion hole 6 of the connector housing 2 into a terminal accommodating space 7 of the housing main part 5.

The connector housing 2 is constituted by an outer hood 9 and the inner housing main part 5. The hood 9 has a locking arm 10 for an opposing female connector (not shown). The housing main part 5 has a plurality of terminal accommodating spaces 7 separated from each other by a row of parallel partition walls 11 (FIG. 2) and also has a resilient terminal locking arm 12 (terminal locking portion) formed unitarily with each partition wall 11, the arm being supported at each end thereof. The terminal locking arm 12 that is a relevant element of the present invention will be discussed later in detail with referring to FIG. 2. The housing main part 5 is formed to be extended from a vertical base wall 13.

The terminal accommodating space 7 has an upper opening 7*a* (FIG. 2) and a lower opening 7*b* each defining a slit. The terminal accommodating space 7 also has a generally rectangular front opening 16 formed with a pin terminal guiding protrusion 17 which decreases an open area of the front opening 16. The pin terminal guiding protrusion 17 serves to stop one of the receptacle terminals and guides an associated pin terminal. The terminal accommodating space 7 is continuous with a rear terminal insertion hole 6. The housing main part 5 has an outer peripheral surface at a base end thereof for mounting a waterproof packing 18 thereon, and the terminal insertion hole 6 receives a waterproof seals 20 mounted on an outer periphery of an electrical cable 19.

The front holder 3 has a generally rectangular, cylindrical wall and is received along an outer peripheral surface of the housing main part 5. The front holder 3 has a top wall 21, a bottom wall 22, upper and lower horizontal spaces 23, 24 each defining a slit, and a plate wall 25 separating the spaces 23, 24. The plate wall 25 is extended from a rear end of the holder and can move into the deflection space 26 of the terminal locking arm 12 of the housing main part 5. In the meantime, an upper wall 27 of the housing main part 5 is inserted into the space 23 and the plurality of partition walls 11 are received in the lower space 24.

In FIG. 1, the front holder 3 is preliminarily locked to the housing main part 5 by a lock means 28 (FIG. 2) In this state, the terminal 8 is inserted into the terminal accommodating space 7 and the terminal locking arm 12 stops a rear end 29*a* (rear shoulder) of a box-shaped electrical contact portion 29 of the terminal 8. Next, the front holder 3 is pushed opposite to the terminal insertion direction. Thereby, the bottom wall 22 of the front holder 3 closes the lower opening 7*b* of the terminal accommodating space 7 and the intermediate plate wall 25 closes the upper opening 7*a* of the terminal accommodating space 7, while the plate wall 25 moves into the deflection space 26 for the terminal locking arm 12 so that the leading end protrusion 25*a* stops the deflection of the terminal locking arm 12. The front holder 3 is finally locked to the housing main part 5 by the lock means 28 (FIG. 2).

Figure 2:
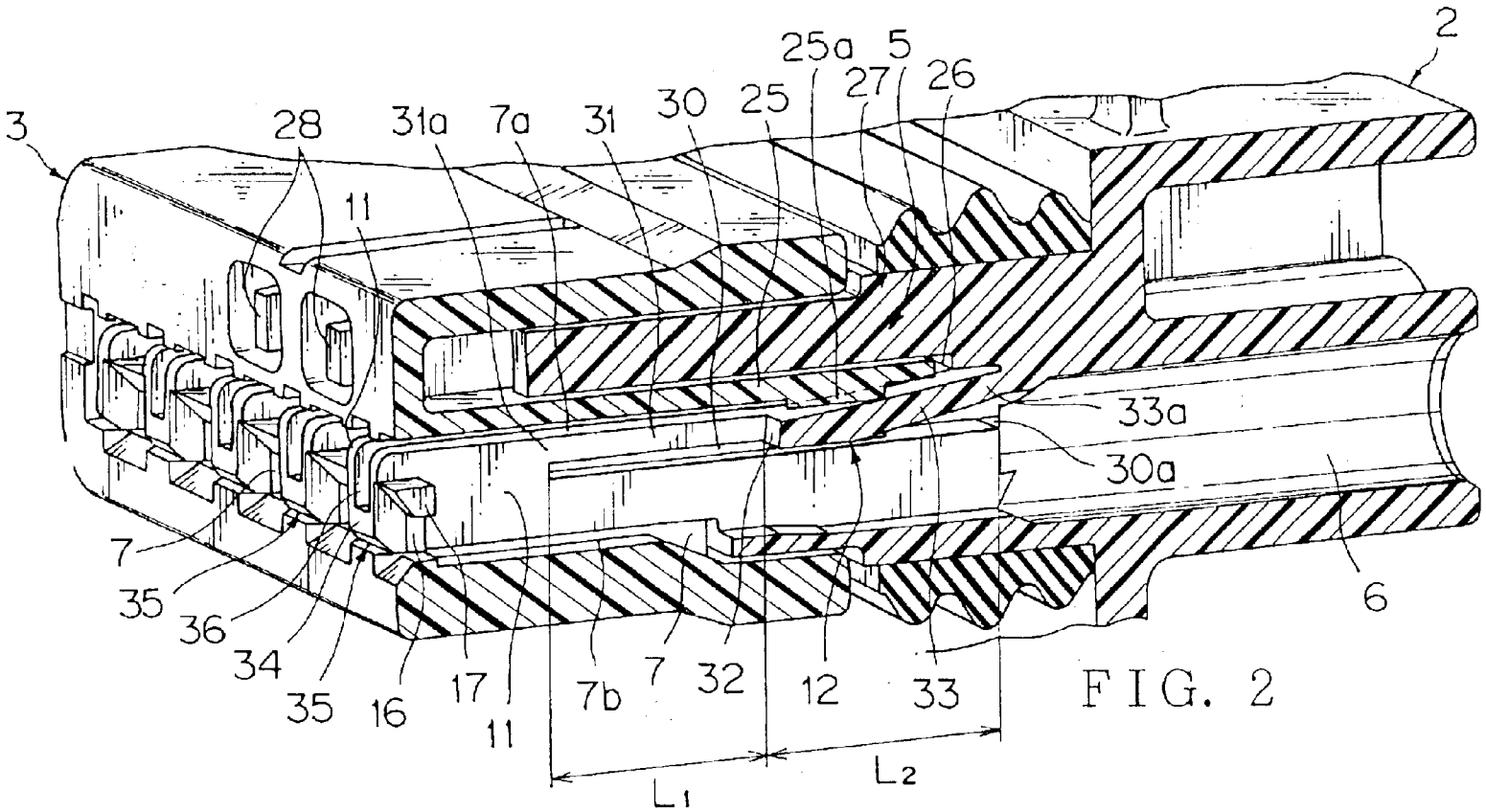
FIG. 2 is a perspective view showing primary parts of the connector.

FIG. 2 shows a state in which the front holder 3 has been finally locked to the housing main part 5. The housing main part 5 has a vertical thin plate partition wall 11 formed with a horizontal slit 30, and a portion of the partition wall 11 which is located above a forward half of the slit 30 defines a fore half 31 of the terminal locking arm 12. The arm fore half 31 is perpendicular to a generally vertical stopping surface 32 (engagement portion) which is a fore end of a rear arm half 33 of the terminal locking arm 12. The rear arm half 33 has an upwardly inclined surface continuous with the upper wall 27 of the housing main part 5 in a base side of the terminal accommodating space 7.

Each of the terminal accommodating space 7 is separated from each other by adjacent two of the vertical partition walls 11 which are joined to a horizontal bottom wall 34 to define generally a U-shape in a longitudinal section thereof. The U-shaped wall 35 is positioned at each side of the terminal accommodating space 7.

Figure 3:
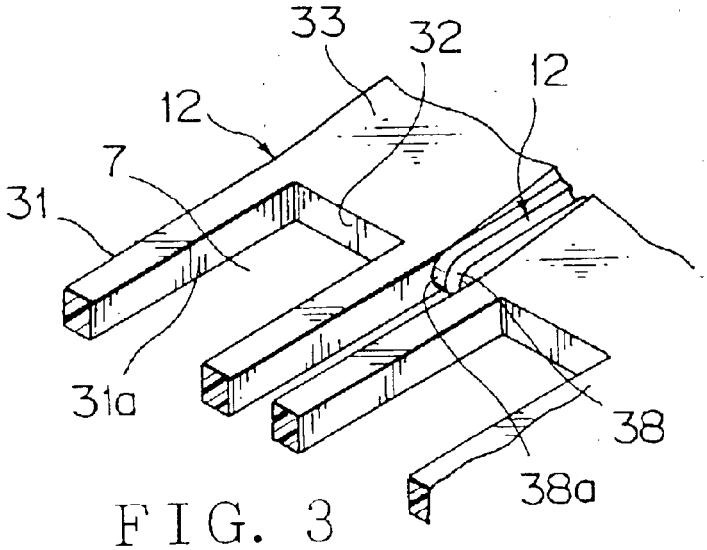
FIG. 3 is a perspective view showing a terminal locking arm.

As illustrated in FIG. 3, the stopping surface 32 joins a pair of side surfaces 31*a* of the forward arm halves 31 which are opposed to each other within the terminal accommodating space 7, and the stopping surface 32 extends laterally across the terminal accommodating space 7. The rear arm half 33 has a width not smaller than the sum of the width of the stopping surface 32 and twice the thickness of the partition wall 11. That is, the terminal locking arm 12 is constituted by the pair of forward arm halves 31, the stopping surface 32 joining the forward arm halves 31, and the rear arm half 33 unitarily contiguous with the stopping surface 32.

As illustrated in FIG. 2, the terminal locking arm 12 is continues with a fore end side surface 31*a* positioned forward from the slit 30, and the terminal locking arm 12 is continuous with the housing main part 5 at a rear end side portion 33*a* positioned inside the upper wall 27 of the housing main part 5, so that the terminal locking arm 12 is supported at each end thereof. The slit 30 has a rear open end 30*a* backwardly continuous with the terminal insertion hole 6.

The forward arm half 31 has a length L1 which is substantially equal to a length L2 of the rear arm half 33 and the stopping surface 32 is positioned at a longitudinal middle of the terminal locking arm 12. Thus, the forward arm half 31 is longitudinally balanced with the rear arm half 33, so that the stopping surface 32 (FIG. 2) moves not longitudinally but vertically when the electrical contact portion 29 of the terminal 8 (FIG. 1) pushes upward the terminal locking arm 12 to deflect the terminal locking arm 12.

This allows a stable smaller clearance between the stopping surface 32 and the rear end 29*a* of the electrical contact portion 29 of the terminal 8 (FIG. 1). The clearance can be almost 0 (zero), eliminating a longitudinal looseness of the terminal 8. The terminal locking arm 12 deflects vertically across the minimum distance which makes the deflection space 26 smaller, decreasing the connector housing 2 in size.

As illustrated in FIG. 2, the height of the forward arm half 31 of the terminal locking arm 12 is determined to be larger than the thickness of the partition wall 11, so that the forward arm half 31 deflects upward linearly without an unstable warp. Thus, the stopping surface 32 does not deviate in the longitudinal direction of the arm, minimizing the connector housing 2 in size.

The stopping surface 32 (FIG. 3) of the terminal locking arm 12 is laterally elongated to abut against the electrical contact portion 29 of the terminal 8 across the whole width of the electrical contact portion 29, and the stopping surface 32 is joined to the forward arm half 31 at each side end of the stopping surface 32, the forward arm half 31 being contiguous with the partition wall 11. Thus, the stopping surface 32 provides a stopper with an increased resistance force, improving the reliability thereof.

Above the partition wall 11 (FIG. 2), there is provided a slit-shaped space for receiving the plate wall 25 of the front holder 3. The terminal 8 can be inserted in the connector housing 2 during a preliminary engagement sate of the front holder 3, i.e. while the plate wall 25 has not been inserted in the slit-shaped space. Thus, both the forward arm half 31 and the rear arm half 33 of the terminal locking arm 12 can deflect in the slit-shaped space unitarily with each other. Subsequently, the front holder 3 is further moved into the connector housing 2 so that the plate wall 25 moves into the slit-shaped space. This eliminates a space specified only for deflection of the terminal locking arm 12, decreasing the height of the connector housing 2.

Figure 4:
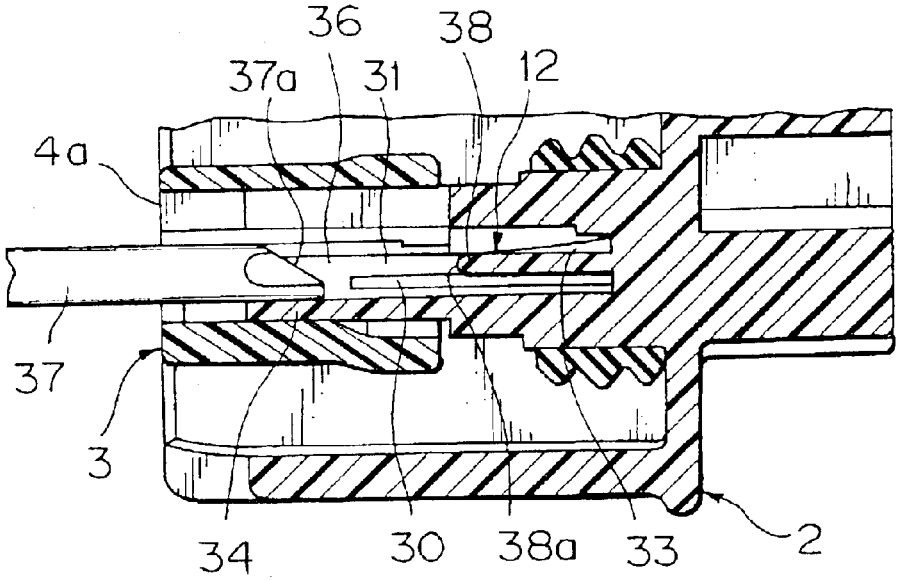
FIG. 4 is a longitudinal sectional view showing a state where the locking of a terminal is released.
Figure 5:
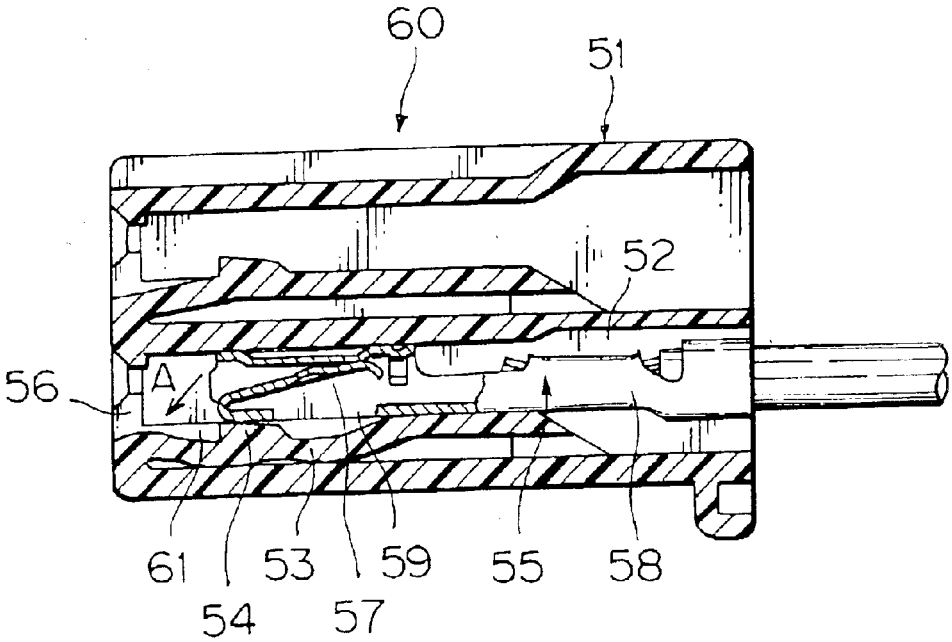
PRIOR ART FIG. 5
FIG. 5 is a perspective view showing a conventional terminal locking structure of a connector.

In FIG. 4, a pushing rod 37 for releasing the terminal is inserted from the front opening 4*a* into a U-channel-shaped space 36 defined by a pair of the adjacent partition walls 11 and the bottom wall 34.

In the space 36 for the pushing rod 37, there is a lock releasing projection 38 shown in FIG. 3 for releasing the engagement of the arm.

The lock releasing projection 38 (FIG. 3) is horizontally extended from a base end of the forward arm half 31 along a side surface of one of the rear arm halves 33 in a lateral side of the stopping surface 32. The rear arm half 33 is slightly inclined in the rear direction thereof while the lock releasing projection 38 is horizontal. The lock releasing projection 38 has a fore end positioned at a longitudinal middle of the terminal locking arm 12 as well as the stopping surface 32. The rear arm half 33 has a width including the thickness of the lock releasing projection 38, and the lock releasing projection 38 has a generally semi-circular curbed surface 38*a* at a fore end thereof. Alternatively, there may be provided another lock releasing projection 38 formed on an outer side surface of each of two adjacent terminal locking arms 12.

As illustrated in FIG. 4, the pushing rod 37 is inserted backward into the U-shaped space 36 while the front holder 3 (FIG. 1) is preliminarily engaged with or disengaged from the connector housing 2. An upward tapered surface 37*a* formed in the pushing rod 37 moves along the curbed surface 38*a* of the lock releasing projection 38 to deflect the terminal locking arm 12 upward.

Since the lock releasing projection 38 is positioned at the longitudinal middle of the terminal locking arm 12 supported by the both ends, the pushing rod 37 can move just upward (vertically) the terminal locking arm 12 by a minimum distance without a longitudinal deviation of the terminal locking arm 12. Thus, there occurs no severe frictional interference between the stopping surface 32 (FIG. 3) and the rear end 29*a* of the electrical contact portion 29 of the terminal 8 (FIG. 1), achieving a smooth, reliable release of the engagement. This allows a smaller movement of the terminal locking arm 12 to release the terminal so that the deflection space 26 (FIG. 2) may be smaller, decreasing the connector housing 2 in size.

In FIG. 2, the upper wall 27 of the housing main part 5 is unitarily formed with a lock arm (locking means) 28, and a lock portion (not-shown) corresponding to the lock arm 28 is provided on the front holder 3 so as to be preliminarily or finally engageable with the lock arm 28. Note that the terminal locking structure according to the present invention is not only applied to the plug-type connector 1 but also to a receptacle-type connector (not shown) having a connector mating chamber. The receptacle-type connector has a housing main part (5), which is constituted by a horizontal lower wall, a plurality of partition walls (11) depending from the lower wall, and a terminal locking arm (12) unitarily formed with each partition wall (11). Between two adjacent partition walls (11) there is defined a pushing rod insertion space (36). An upper opening (7*a*) of a terminal accommodating space (7) is covered by a plate wall (25) of a front holder (3) for preventing the deflection of the locking arm. A pin terminal (not shown) has a locked portion which is a rear end of a box-shaped portion continuous with a pin contact.

Furthermore, the terminal locking structure according to the present invention can be applied to a connector having a plurality of terminal accommodation spaces layered one another. The terminal locking structure may be also applied to a conventional connector having vertical partitions as mentioned above but with no front holder 3. Note that the locked portion of the terminal is not limited in the rear end of the box-shaped portion of the terminal.

Figure 6:
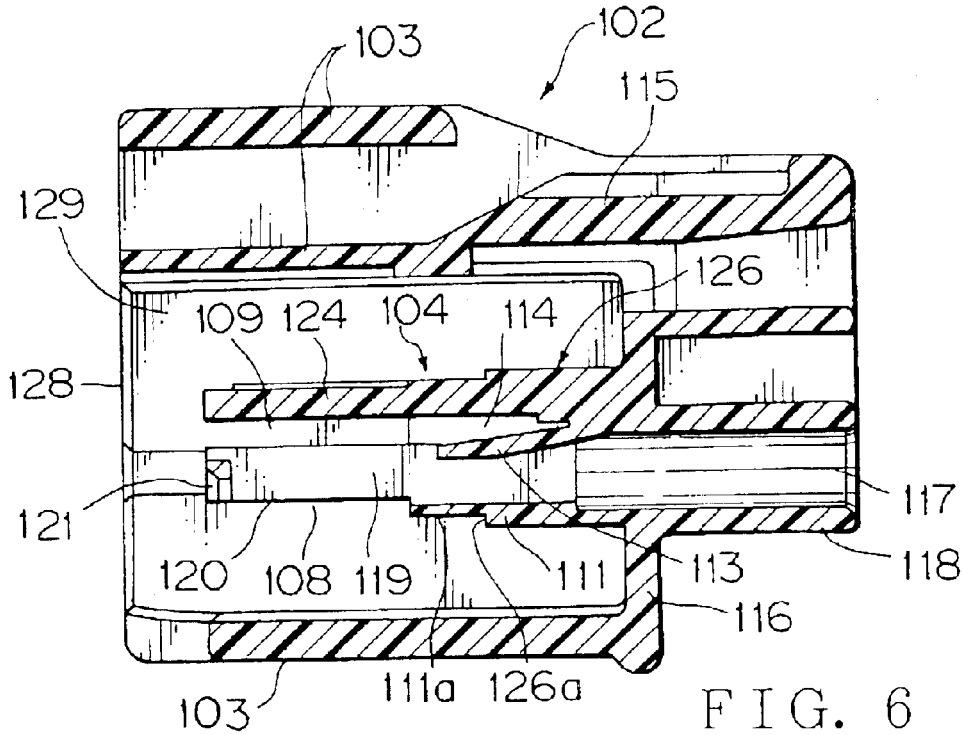
FIG. 6 is a longitudinal sectional view showing a connector housing of a first embodiment of a holder combined connector according to the present invention.
Figure 7:
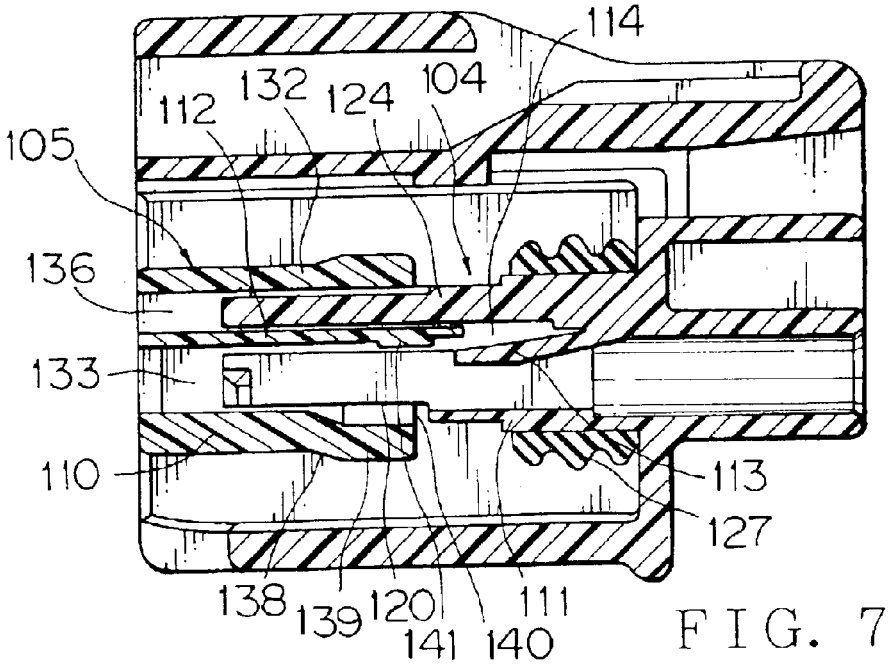
FIG. 7 is a longitudinal sectional view showing the connector housing in which a front holder is preliminarily inserted.
Figure 8:
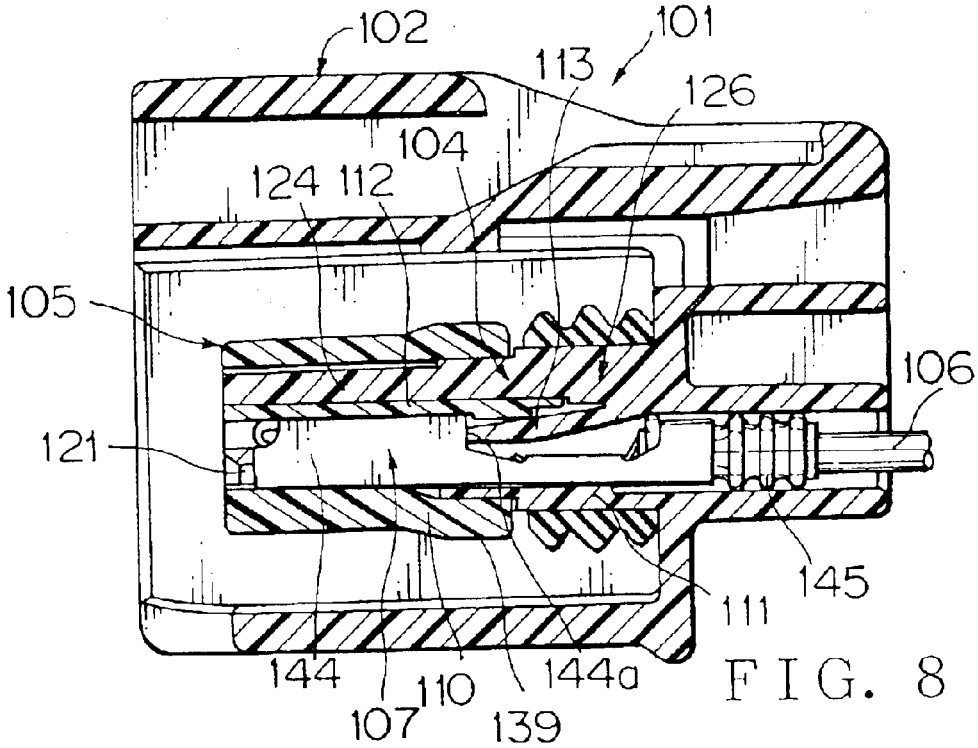
FIG. 8 is a longitudinal sectional view showing the connector housing in which a terminal is inserted and the front holder is finally inserted.

FIGS. 6 to 8 show an embodiment of a holder combined connector according to the present invention.

The holder combined connector 101 (FIG. 8) is constituted by a plug-type connector housing 102 made of a synthetic resin material, a front holder 105 also made of a synthetic resin material, and a receptacle terminal 107 with an electrical cable 106. The front holder 105 is coupled to a housing main part 104 positioned inside a hood 103 of the connector housing 102 as illustrated in FIG. 7. The terminal 107 is inserted into the connector housing 102 and into the front holder 105 as illustrated in FIG. 8.

As illustrated in FIG. 6, the housing main part 104 has a terminal accommodating space with a bottom wall (cavity bottom wall), a fore half of which is widely opened. A top wall (cavity top wall) of the terminal accommodating space is also largely opened. Reference numerals 108 and 109 designate the opened portions. As illustrated in FIG. 8, the front holder 105 has a bottom wall 110, which closes the lower opening 108 so as to be combined with a short rear bottom wall 111 of the housing main part 104 to complimentarily define a cavity bottom wall. Furthermore, the front holder 105 has a plate wall 112 for double locking the terminal, which closes the upper opening 109 to complimentarily define a cavity upper wall. The plate wall 112 advances into an arm deflection space 114 of a terminal locking arm 113 of the housing main part 104 for double locking the terminal 107.

As illustrated in FIG. 6, the connector housing 102 has the hood 103 of a generally rectangular circumferential shape in an outer side thereof. The hood 103 is formed with a horizontal lock arm 115 for an opposing female connector (not shown) Within an inner space 129 of the hood 103, there is provided a vertical base wall 116 from which the housing main part 104 is unitarily extended forward. Rearward from the base wall 116, there is formed a generally cylindrical terminal insertion portion 118 having a terminal insertion hole 117. The terminal insertion hole 117 is contiguous with a terminal accommodating space 119 of the housing main part 104, and a plurality of terminal accommodating spaces 119 are provided longitudinally parallel to each other. The terminal insertion portion 118 is provided for each terminal accommodating space 119.

Figure 9:
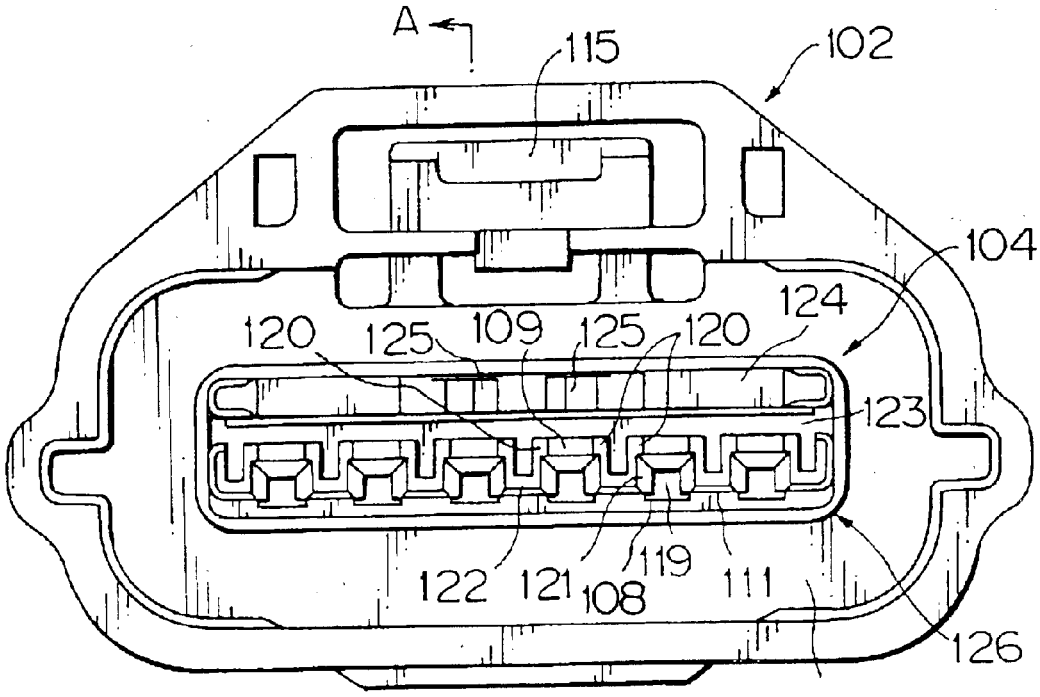
FIG. 9 is a front view showing the connector housing.

As illustrated in FIG. 9, which is a front view of the connector housing 102, each terminal accommodating space 119 is defined between left and right vertical partition walls 120 and has the lower and upper openings 108, 109. Each partition wall 120 is extended from an inner wall of the terminal insertion hole 117 (FIG. 6) parallel to the terminal insertion direction. The partition wall 120 has a stopper protrusion 121 at fore end thereof for abutting the terminal 107 (FIG. 8). FIG. 6 is a sectional view taken along line A—A of FIG. 9. In this specification, the connector having the housing main part 104 is defined as a plug-type connector and an opposing connector having an engagement chamber for coupling of the housing main part 104 is defined as a receptacle-type connector.

In FIG. 9, between adjacent two of the terminal accommodating spaces 119, a narrow horizontal connection wall 122 is provided to join the partition walls 120. The connection wall 122 and the partition walls 120 positioned at each side of the connection wall 122 constitute a longitudinally U-shaped wall. The connection wall 122 has a longitudinal length the same as that of the partition wall 120 illustrated in FIG. 6 (the connection wall 122 is not shown in FIG. 6). Above the opening 109 of the terminal accommodating space 119, there is provided a horizontal slit-shaped insertion space 123 for receiving a plate. Further above the plate wall insertion space 123, there are an upper wall 124 of the housing main part 104 and a lock arm 125 unitarily with the upper wall 124. The lock arm 125 is positioned in the same horizontal plain as the upper wail 124. The lock arm 125 is formed with a preliminary locking portion and a final locking portion for the front holder 105 sequentially in a longitudinal direction thereof.

The lock arm 125 locks the front holder 105 and is positioned in the same plane as the upper wall 124 so that decreases the height of the connector housing 2. In FIG. 9, reference numeral 126 designates a rectangular circumferential peripheral wall extended from the base wall 116. On the peripheral wall 126, there are unitarily formed the upper wall 124 having a larger thickness and a rear half of the bottom wall 111 having a small thickness.

As illustrated in FIG. 6, the peripheral wall 126 has an intermediate step 126*a* which further decreases a forward part 111*a* of the rear bottom wall 111 in thickness. On an outer surface of the rear bottom wall 111, as illustrated in FIG. 7, a waterproof packing 127 is mounted to contact an opposing plug-type connector (not shown). The upper wall 124 of the housing main part 104 (FIG. 6) is extended from the base wall 116 to come near a front opening 128 of the hood 103. The rear bottom wall 111 is extended short from the base wall 116 parallel to the upper wall 124 so as to have a substantially half length of the upper wall 124.

From a base side of the upper wall 124, the resilient terminal locking arm 113 is provided in each terminal accommodating space 119 so as to extend forward and diagonally downward. Between the terminal locking arm 113 and the upper wall 124, the arm deflection space 114 is positioned, and the terminal locking arm 113 has a fore end located slightly backward than a forward end of the rear bottom wall 111.

As illustrated in FIG. 7, the front holder 105 outwardly engages with the housing main part 104 while the terminal 107 (FIG. 8) is not inserted into the connector. The front holder 105 is preliminarily locked by the lock arm 125 (FIG. 9) and the locking portion (not shown) of the front holder 105.

Figure 10:
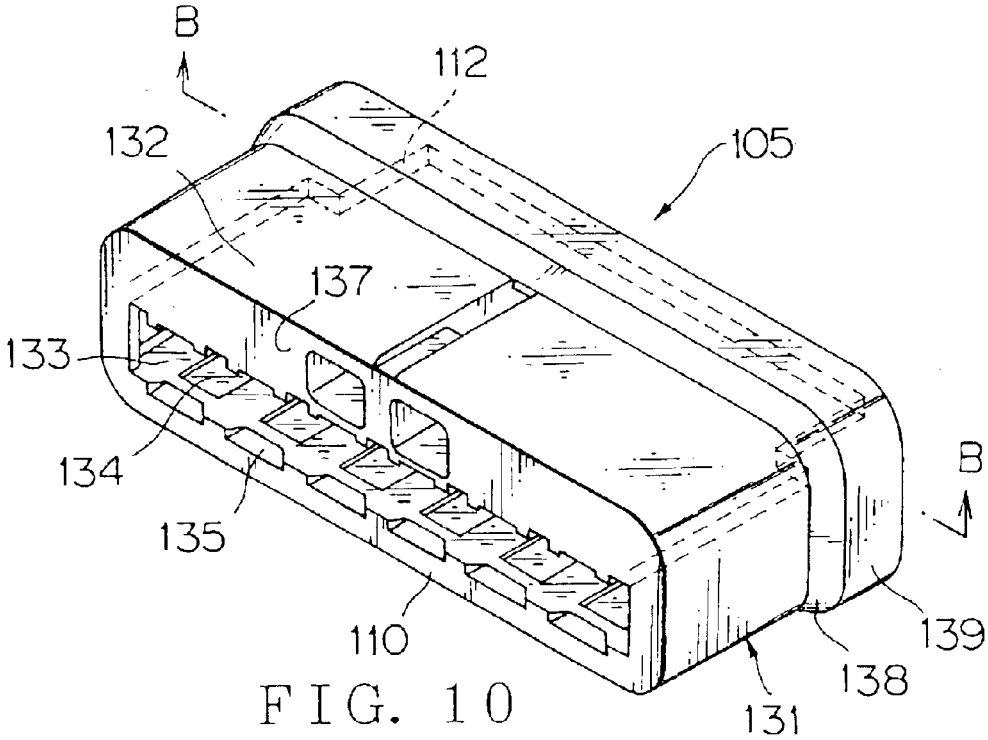
FIG. 10 is a perspective view (taken diagonally backward) showing the front holder.

As illustrated in an example of the front holder 105 of FIG. 10, the front holder 105 is generally cylindrical. The front holder 105 has a bottom wall 110 unitarily with a peripheral wall 131 having a larger thickness, a top wall 132 having a slightly smaller thickness as illustrated in FIG. 7, and the plate wall 112 positioned under the top wall 132 for double locking the terminal. Between the bottom wall 110 and the plate wall 112, a laterally elongated slit-shaped space 133 is defined for inserting each partition wall 120. The bottom wall 110 is formed with a shallow U-shaped groove 134 partially defining a terminal accommodating chamber. The groove 134 is opposed to the opening 108 of the terminal accommodating space 119 (FIG. 6) of the housing main part 104. The front holder 105 has a tapered guide surface 135 at a forward end of the front holder 105 for each groove 134 to guide an opposing pin terminal (not shown). As illustrated in FIG. 7, between the top wall 132 and the plate wall 112, there is defined a laterally elongated slit-shaped space 136 for receiving the upper wall 124 of the housing main part 104. As illustrated in FIG. 10, the top wall 132 and the plate wall 112 are joined by a front wall 137.

As illustrated in FIG. 10, within the space 136 defined between the top wall 132 and the plate wall 112, there is provided a locking portion (not shown) for the housing main part 104 (FIG. 7). The peripheral wall 131 has a rear enlarged portion 139 contiguous with a tapered portion 138. The enlarged portion 139 can receive a fore half (shown by reference numeral 111*a*) of the peripheral wall 126 (FIG. 6) of the housing main part 104.

As illustrated in FIG. 7, the plate wall 112 for the double-locking has a thin thickness and is elongated parallel to the top wall 132 to extend from the enlarged portion 139 of the front holder 105. A leading end portion of the plate wall 112 can be inserted into the arm deflection space 114 of the housing main part 104. The leading end portion of the plate wall 112 is formed with a protrusion 141 which can contact a surface of the terminal locking arm 113.

Figure 11:
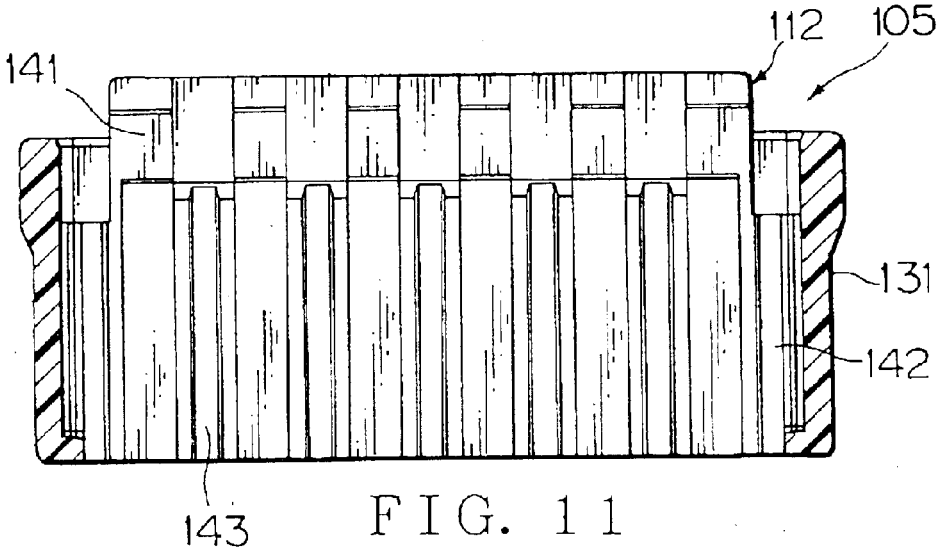
FIG. 11 is a sectional view taken line B—B of FIG. 10.

As illustrated in FIG. 11 which is a sectional view taken along line B—B of FIG. 10, the terminal locking plate wall 112 is a generally rectangular flat plate having a width slightly smaller than the inner width of the front holder 105. A plurality of the protrusions 141 are provided each for each terminal accommodating space 119 (FIG. 6). Each side end 142 of the plate wall 112 is joined to an inner wall of the peripheral wall 131. In FIG. 11, reference numeral 143 designates a channel portion.

In a preliminarily engaged state of the front holder 105 which is shown in FIG. 7, the upper wall 124 of the housing main part 104 is inserted halfway between the top wall 132 and the plate wall 112 of the front holder 105. The locking protrusion 141 of the plate wall 112 is still positioned forward from the fore end of the terminal locking arm 113 (forward from the locking arm deflection space), so that the terminal locking arm 113 can be feely deflected. The partition wall 120 of the housing main part 104 is inserted halfway in the space 133 positioned in a lower side of front holder. The bottom wall 110 of the front holder 105 is contacting a forward lower surface of the partition wall 120 of the housing main part 104. The enlarged portion 139 formed in a rear end portion of the bottom wall 110 is positioned a little forward from the bottom wall rear half 111 of the housing main part 104.

In the preliminarily engaged state of the front holder 105, the terminal 107 is completely inserted into the front holder 105. At this step, the forward box-shaped electrical contact portion 144 of the terminal 107 advances into the terminal accommodating space 119 of the housing main part 104, while the electrical contact portion 144 is deflecting the terminal locking arm 113. The electrical contact portion 144 also advances halfway into the space 133 of the housing main part 104 way along the bottom wall 110 of the front holder 105 until the electrical contact portion 144 abuts against the stopper protrusion 121 formed at the fore end of the partition wall to be stopped there. The bottom wall 110 of the front holder 105 guides forward the fore end lower portion of the terminal 107 so that the terminal 107 (FIG. 8) is inserted smoothly. The fore end of the terminal locking arm 113 abuts against a rear shoulder 144*a* of the box-shaped electrical contact portion 144 of the terminal 107 to lock the terminal 107. In the embodiment, the electrical cable 106 connected to the terminal has a waterproof rubber packing 145 received in the terminal insertion hole 117.

After the insertion of the terminal, the front holder 105 is completely inserted so that the front holder 105 is finally engaged with the housing main part 104 as illustrated in FIG. 8. At the same time, the leading end portion of the plate wall 112 of the front holder 105 advances into the arm deflection space 114 to prevent the deflection of the terminal locking arm 113 for double locking the terminal 107. In the meantime, the upper wall 124 of the housing main part 104 is completely inserted into the upper space 136 (FIG. 7) of the front holder 105, while the terminal 107 is finally received in the lower space 133 (FIG. 7) of the front holder 105. The circumferential enlarged portion 139 of the front holder 105 is engaged with an outer peripheral surface of a forward half of the peripheral wall 126 of the housing main part 104.

Thus, the thick upper wall 124 of the housing main part 104 is deeply inserted into the front holder 105 so that the front holder 105 is stably retained by the housing main part 104 without looseness or distortion, and the terminal is also reliably held. Furthermore, the thin plate wall 112 for double locking the terminal also serves as an upper wall of the terminal accommodating chamber, simplifying the structure and decreasing the height of the connector housing 102. The bottom wall 110 of the front holder 105 complimentarily provides a cavity bottom wall of the housing main part 104, so that the height of the connector housing 102 can be decreased by the bottom wall thickness of a conventional housing main part which is molded from a resin material. The terminal accommodating chamber can be also decreased in size. The waterproof packing 127 attached on the peripheral wall 126 in a base side of the housing main part 104 achieves a sure waterproof of the connector together with an opposing connector.

When there is not provided a waterproof packing 127, the upper wall 124 of the housing main part 104 is extended from the base wall 116 of the connector housing 102 (FIG. 6) and the peripheral wall 126 is eliminated. Without the rear bottom wall 111 of the housing main part 104, a bottom wall of the terminal accommodating chamber (cavity bottom wall) may be substituted by the bottom wall 110 of the front holder 105. In these cases, the horizontal connection wall 122 of the housing main part 104 is preferably provided between the terminal accommodating chambers 109 in view of positioning and strength of the terminal accommodating chambers. In this embodiment, a cavity bottom wall of the housing main part 104 is eliminated. Alternatively, a cavity top wall may be eliminated in place of the cavity bottom wall to modify the arrangement of FIG. 8.

Figure 12:
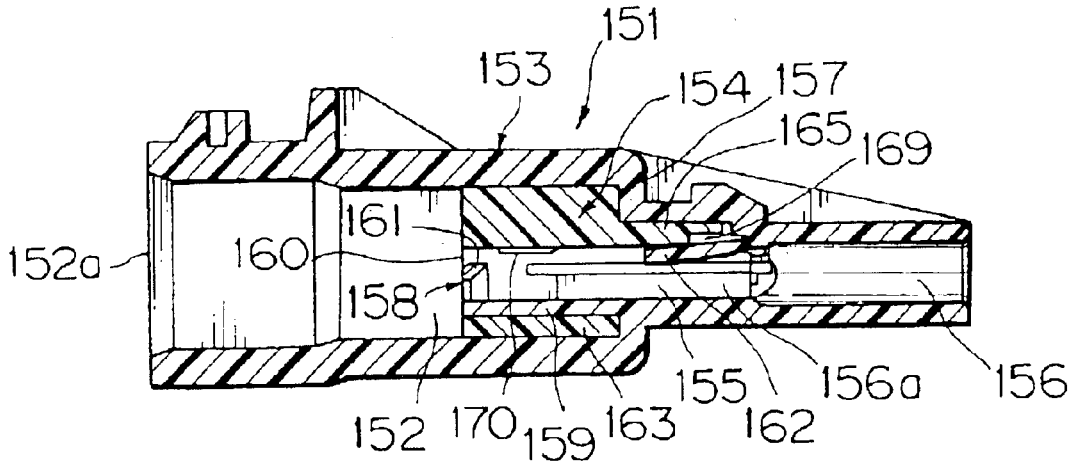
FIG. 12 is a longitudinal sectional view showing a second embodiment of a holder combined connector according to the present invention.
Figure 13:
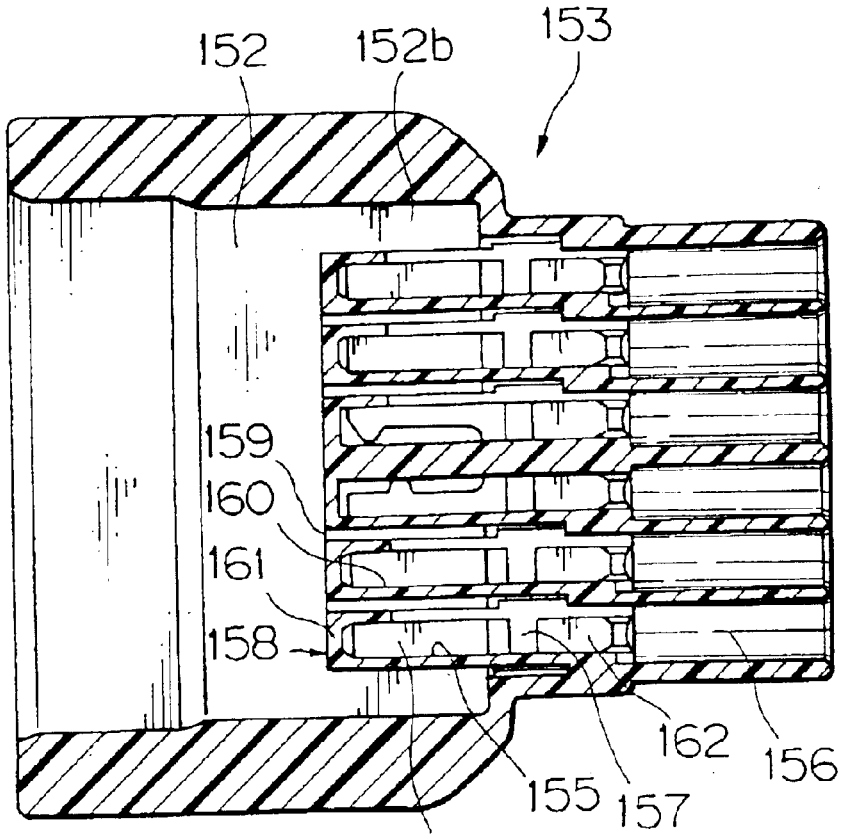
FIG. 13 is a longitudinal sectional view showing a connector housing of the second embodiment.
Figure 14:
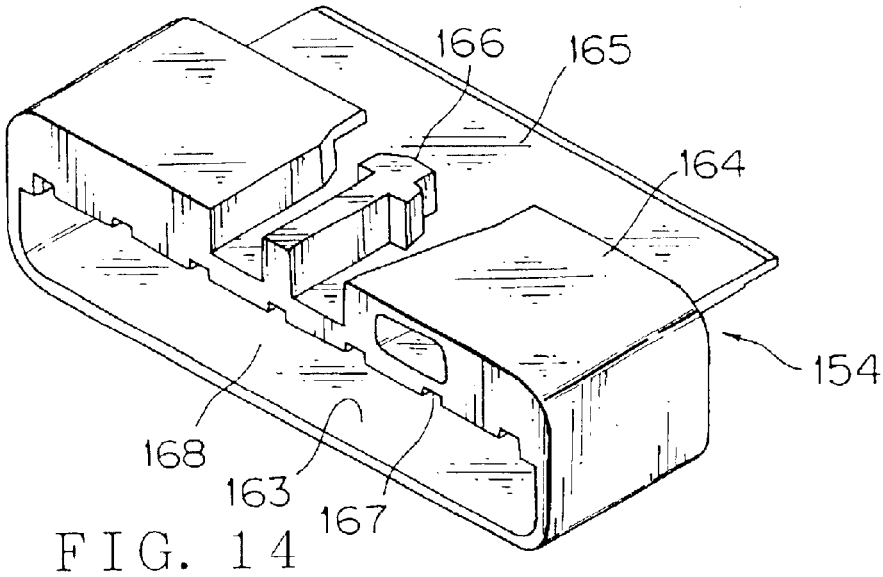
FIG. 14 is a perspective view showing a front holder of the second embodiment.
Figure 15:
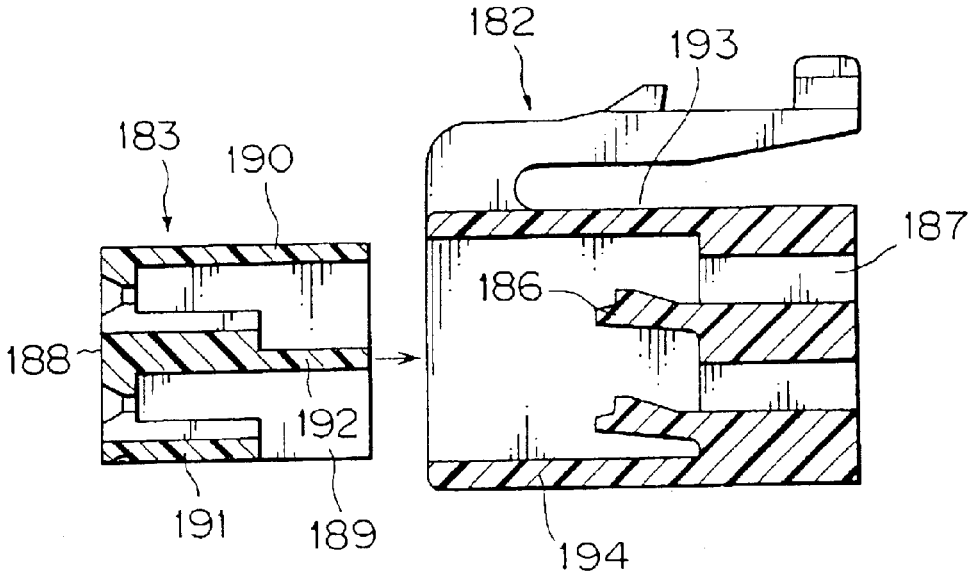
PRIOR ART FIG. 15
FIG. 15 is a longitudinal sectional view showing a conventional holder combined connector in a disengaged state thereof.
Figure 16:
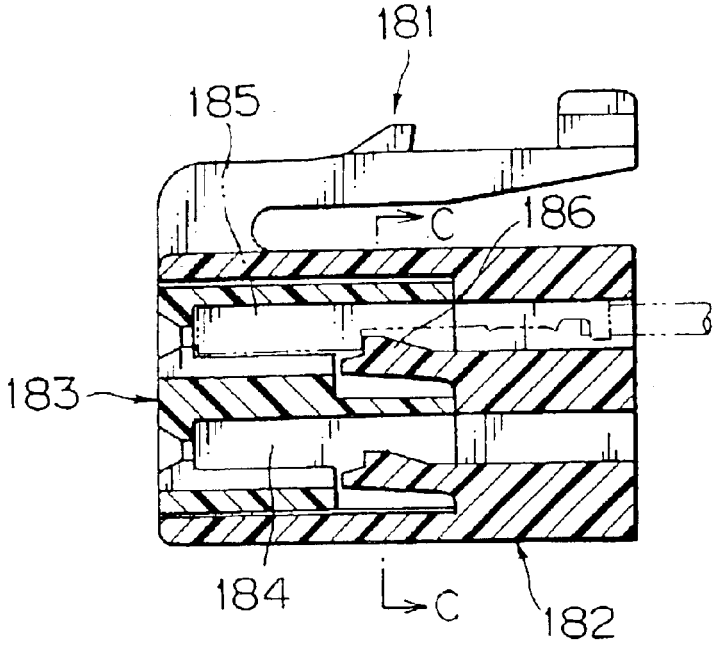
PRIOR ART FIG. 16
FIG. 16 is a longitudinal sectional view showing the conventional holder combined connector in its engaged state.
Figure 17:
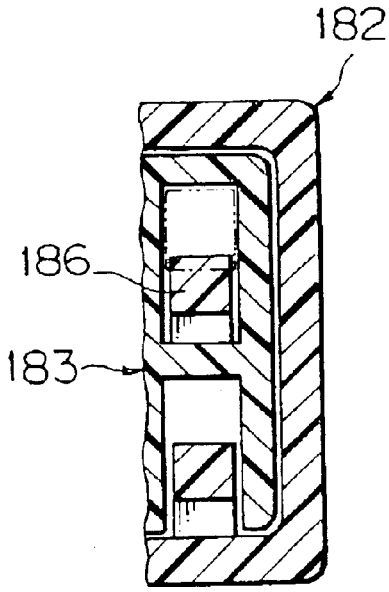
PRIOR ART FIG. 17
FIG. 17 is a cross-sectional view taken along line C—C of FIG. 16 for showing the conventional holder combined connector.

FIG. 12 shows a second embodiment of a holder combined connector according to the present invention. FIGS. 13 and 14 each show a female connector housing or a front holder which constitutes the holder combined connector.

As illustrated in FIG. 12, a holder combined connector 151 is a female one corresponding to the plug-type connector 101 of the first embodiment. The holder combined connector 151 has a female connector housing 153 having a connector engagement space 152, a front holder 154 which is inserted from a front opening 152*a* into the connector engagement space 152, and a terminal (not shown) with a cable which is inserted from a rear insertion hole 156 into a terminal accommodating cavity 155 of the front holder 154.

As illustrated in FIGS. 12 and 13, within the connector engagement space 152 of the connector housing 153, a housing main part 158 is provided to extend forward. The housing main part 158 has a horizontal bottom wall 159, a plurality of partition walls 160 raised from the bottom wall 159, and a plurality of stopper protrusions 161 positioned in a fore end side of the partition walls 160. The bottom wall 159 and a pair of adjacent partition walls 160 define the terminal accommodating cavity 155 having a U-shaped cross section. The terminal accommodating cavities 155 are arranged laterally parallel to each other. In the second embodiment, a cavity upper wall is eliminated while a cavity bottom wall is eliminated in the first embodiment.

The bottom wall 159 of the housing main part 158 is a single rectangular plate extended from a base wall 157 to horizontally join each partition wall 160 to the bottom wall 159. The terminal accommodating cavity 155 is contiguous with a rear terminal insertion hole 156*a*. Within the terminal insertion hole 156*a*, a resilient terminal locking arm 162 is provided. Opposed to an upper opening 171 of the terminal accommodating cavity 155, a pair of lock arms (not shown) for a front holder 154 is provided. In the connector engagement space 152, a circumferential holder receiving space 152*b* is defined around the housing main part 158.

As illustrated in FIG. 14, the front holder 154 has a bottom wall 163 and a top wall 164 to be defined in a rectangular cylindrical shape. Under the top wall 164, there is disposed a plate wall 165 for double locking a terminal. The plate wall 165 is horizontality longer than that of the first embodiment. On an upper surface of the plate wall 165, there is provided a locking portion 166 inserted into the pair of lock arms. In a lower surface of the plate wall 165, a plurality of grooves 167 are provided for slidingly receiving the partition walls 160 (FIG. 12). Between the plate wall 165 and the bottom wall 163, there is defined a laterally elongated space 168 for receiving the housing main part 158 (FIG. 13). On a lower surface of the plate wall 165, there is formed a protrusion 170 under the top wall 164 for pressing a box-shaped portion (not shown) of the terminal as illustrated in FIG. 12.

In FIG. 12, the front holder 154 is completely inserted in the connector housing 153 to be finally locked thereto. As well as the first embodiment, a pin terminal (not shown) is inserted forward in a preliminary insertion (engagement) state of the front holder 154. Thereby, a contact pin (not shown) of the pin terminal is extended into the connector engagement space 152 through the front holder 154, and the terminal locking arm 162 locks a rear end of a box-shaped portion of the pin terminal. The terminal is pressed by the protrusion 170 to be reliably held.

Subsequently, the front holder 154 is completely pushed into the connector engagement space 152 to be finally locked by a locking means (lock arm and lock portion 166). The plate wall 165 of the front holder 154 advances into a deflection space 169 for the terminal locking arm 162 to prevent the deflection of the terminal locking arm 162 and to define an upper wall of the terminal accommodating cavity 155 for the terminal accommodating chamber.

The second embodiment achieves operational effects similar to the first embodiment. Particularly, the double-locking plate wall 165 of the front holder 154 also serves as an upper wall of the terminal accommodating chamber, so that the height of the housing main part 158 can be decreased when the connector housing 153 is molded from a resin material. This decreases the height of the connector housing 153, i.e. of the holder combined connector 151.

What is claimed is:

1. An electrical connector having a terminal locking structure wherein the structure comprises a resilient terminal locking arm having a pair of forward halves opposed to each other in a transverse direction of the connector, and a rear half, the forward halves defined by a wall for a terminal accommodating space of a housing of the connector, the rear half being larger than the pair of forward halves in width, the rear half having a fore end to serve as a terminal stopping surface, wherein the terminal stopping surface extends across a width of the terminal accommodation space between the pair of forward halves.

2. The connector according to claim 1 wherein the terminal stopping surface is positioned substantially at a middle of the terminal locking arm in a longitudinal direction of the connector.

3. The connector according to claim 1 wherein the rear half has a surface tapered in a longitudinal direction of the connector.

4. The connector according to claim 1 wherein the connector has a front holder which is coupled to a connector main part of the connector housing to complimentarily define a terminal accommodating chamber.

5. An electrical connector having a terminal locking structure wherein the structure comprises a resilient terminal locking arm having a forward half and a rear half, the forward half defined by a wall for a terminal accommodating space of a housing of the connector, the rear half being larger than the forward half in width, the rear half having a fore end to serve as a terminal stopping surface, wherein the terminal locking arm has a lock releasing portion at a middle of the terminal locking arm in a longitudinal direction of the terminal locking arm so that a tip of a pushing rod can push the lock releasing portion to release the terminal from the terminal locking arm, and the lock releasing portion is a projection formed on a side surface of the terminal locking arm.

* * * * *